US011624260B2

(12) United States Patent
Nanney et al.

(10) Patent No.: US 11,624,260 B2
(45) Date of Patent: Apr. 11, 2023

(54) NESTED FIN CEMENT WIPER PLUGS

(71) Applicant: EOG Resources, Inc., Houston, TX (US)

(72) Inventors: James Greer Nanney, Midland, TX (US); Logan Daniel Farmar, Midland, TX (US)

(73) Assignee: EOG RESOURCES, INC., Houston, TX (US)

( * ) Notice: Subject to any disclaimer, the term of this patent is extended or adjusted under 35 U.S.C. 154(b) by 252 days.

(21) Appl. No.: 17/096,568

(22) Filed: Nov. 12, 2020

(65) Prior Publication Data

US 2021/0140275 A1 May 13, 2021

Related U.S. Application Data

(60) Provisional application No. 62/934,918, filed on Nov. 13, 2019.

(51) Int. Cl.

| | |
|---|---|
| ***E21B 37/10*** | (2006.01) |
| ***E21B 33/12*** | (2006.01) |
| ***E21B 33/16*** | (2006.01) |

(52) U.S. Cl.

CPC ..... *E21B 37/10* (2013.01); *E21B 33/12* (2013.01); *E21B 33/16* (2013.01)

(58) Field of Classification Search

CPC ..... E21B 33/12

See application file for complete search history.

(56) References Cited

U.S. PATENT DOCUMENTS

| | | | | |
|---|---|---|---|---|
| 4,671,358 | A | 6/1987 | Lindsey, Jr. et al. | |
| 5,095,988 | A | 3/1992 | Bode | |
| 6,561,270 | B1 | 5/2003 | Budde | |
| 2002/0104656 | A1 | 8/2002 | Murley et al. | |
| 2002/0144814 | A1 | 10/2002 | Allamon et al. | |
| 2018/0023363 | A1* | 1/2018 | Wise | E21B 34/10 166/285 |
| 2018/0080304 | A1* | 3/2018 | Cortez | E21B 17/1014 |
| 2019/0017348 | A1* | 1/2019 | Nanney | E21B 33/14 |

* cited by examiner

*Primary Examiner* — William D Hutton, Jr.
*Assistant Examiner* — Avi T Skaist
(74) *Attorney, Agent, or Firm* — Conley Rose, P.C.

(57) ABSTRACT

A cement wiper plug for deployment in casing with an inner radius has a central axis, a leading end, and a trailing end opposite the leading end. The wiper plug includes an elongate body. In addition, the wiper plug includes a first plurality of axially adjacent annular fins mounted to the body. Each fin extends radially outward from the body and each fin extends circumferentially about the body. The first plurality of fins includes a first fin and a second fin axially adjacent the first fin. The second fin is axially positioned between the first fin and the trailing end. The first fin and the second fin are configured to contact each other in the casing. The second fin is configured to bias the first fin radially outward and axially forward toward the leading end.

19 Claims, 7 Drawing Sheets

NESTED FIN CEMENT WIPER PLUGS

CROSS-REFERENCE TO RELATED APPLICATIONS

This application claims benefit of U.S. provisional patent application Ser. No. 62/934,918 filed Nov. 13, 2019, and entitled "Nested Fin Cement Wiper Plugs," which is hereby incorporated herein by reference in its entirety for all purposes.

STATEMENT REGARDING FEDERALLY SPONSORED RESEARCH OR DEVELOPMENT

Not applicable.

BACKGROUND

This disclosure relates generally to wellbore cementing operations. More particularly, the disclosure relates to cement wiper plugs for removing cement from the inside of casing during completion operations.

To obtain hydrocarbons from a subterranean formation, a borehole is drilled from the surface to access a hydrocarbon-bearing reservoir within the subterranean formation. After drilling the borehole to the desired location, completion operations are performed to prepare the borehole for production of the hydrocarbons.

To drill the borehole into the formation, it is conventional practice to connect a drill bit to the lower end of a drill string. The drill bit is then rotated either alone (via a downhole motor) or along with the drillstring as weight-on-bit (WOB) is applied to urge the drill bit into the formation and drill the borehole along a predetermined path through the subterranean formation toward the hydrocarbon-bearing reservoir.

After drilling the borehole, completion operations commence by casing the borehole. In particular, tubular casing is inserted into the borehole to line the borehole, to provide additional structural reinforcement for borehole (i.e., to prevent collapse of the borehole sidewall), and to prevent the undesired flow of fluid(s) between the inside of the borehole and the surrounding formation. To secure the casing in position within the borehole, a cement slurry is pumped down the casing and allowed to flow back up the annulus between the casing and the borehole sidewall. To reduce contamination of the cement slurry, and thereby maintain the desired composition and performance of the cement, cement or wiper plugs are often used to separate the cement slurry from other fluids in the borehole and casing such as drilling mud, water, hydrocarbons, etc. More specifically, a bottom cement wiper plug is often launched down the casing immediately ahead of the cement slurry to minimize contamination of the cement by fluids in the casing prior to pumping the cement slurry down the casing; and a top cement wiper plug is often launched down the casing immediately behind the cement slurry to push the cement slurry out of the casing to ensure the cement slurry is sufficiently advanced through the annulus and to clear the inside of the casing from cement. The cement slurry in the annulus is then allowed to set and cure, thereby securing the casing in position within the borehole.

After securing the casing in place, completion operations continue by establishing fluid communication between a production zone of the hydrocarbon-bearing reservoir within the subterranean formation and the inside of the casing. For example, the casing may be perforated and/or a screen may be installed along the portion of the borehole adjacent the production zone.

BRIEF SUMMARY OF THE DISCLOSURE

Embodiments of cement wiper plugs for deployment in casing are disclosed herein. In one embodiment, a cement wiper plug has a central axis, a leading end, and a trailing end opposite the leading end. In addition, the cement wiper plug comprises an elongate body. Further, the cement wiper plug comprises a first plurality of axially adjacent annular fins mounted to the body. Each fin extends radially outward from the body and each fin extends circumferentially about the body. The first plurality of fins includes a first fin and a second fin axially adjacent the first fin. The second fin is axially positioned between the first fin and the trailing end. The first fin and the second fin are configured to contact each other in the casing. The second fin is configured to bias the first fin radially outward and axially forward toward the leading end.

In another embodiment, a cement wiper plug has a central axis, a leading end, and a trailing end opposite the leading end. The cement wiper plug comprises an elongate body. Further, the cement wiper plug comprises a first plurality of axially adjacent annular fins mounted to the body. Each fin first plurality of fins extends radially outward from the body and each fin first plurality of fins extends circumferentially about the body. The first plurality of fins comprises a leading fin proximal the leading end of the cement wiper plug, a trailing fin proximal the trailing end of the cement wiper plug, and at least one intermediate fin axially positioned between the leading fin and the trailing fin. Each fin of the first plurality of fins has a base fixably coupled to the body, a radially outer surface opposite the base, a leading surface proximal the leading end and extending radially from the base to the radially outer surface, and a trailing surface proximal the trailing end and extending radially from the base to the radially outer surface. Each fin of the first plurality of fins has a central axis in cross-sectional side view that is centered between the leading surface and the trailing surface of the fin. Each fin of the first plurality of fins is oriented at an acute angle measured from the central axis of the body to the central axis of the fin. Each fin of the first plurality of fins extends radially outward from the body to an outer radius measured radially from the central axis. The outer radius of at least two fins of the first plurality of fins are different or the acute angle of at least two fins of the first plurality of fins are different.

Embodiments of methods for maintaining separation of fluids within casing during a completion operation are disclosed herein. In one embodiment, the method comprises (a) launching a cement wiper plug into the casing. The cement wiper plug has a central axis, a leading end, and a trailing end opposite the leading end. The cement wiper plug comprises an elongate body. The cement wiper plug also comprises a plurality of axially adjacent annular fins mounted to the body. Each fin extends radially outward from the body and each fin extends circumferentially about the body. The plurality of fins comprises a first fin proximal the leading end of the wiper plug and a second fin distal the leading end. In addition, the method comprises (b) contacting the second fin with the first fin after (a). Further, the method comprises (c) advancing the cement wiper plug through the casing after (a) and (b). Still further, the method comprises (d) contacting and sealingly engaging the casing with the first fin during (c) while maintaining contact between the first fin and the second fin. Moreover, the method comprises (e) maintaining radial spacing between the casing and the second fin during (d).

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION OF THE PREFERRED EMBODIMENTS

Figure 1:
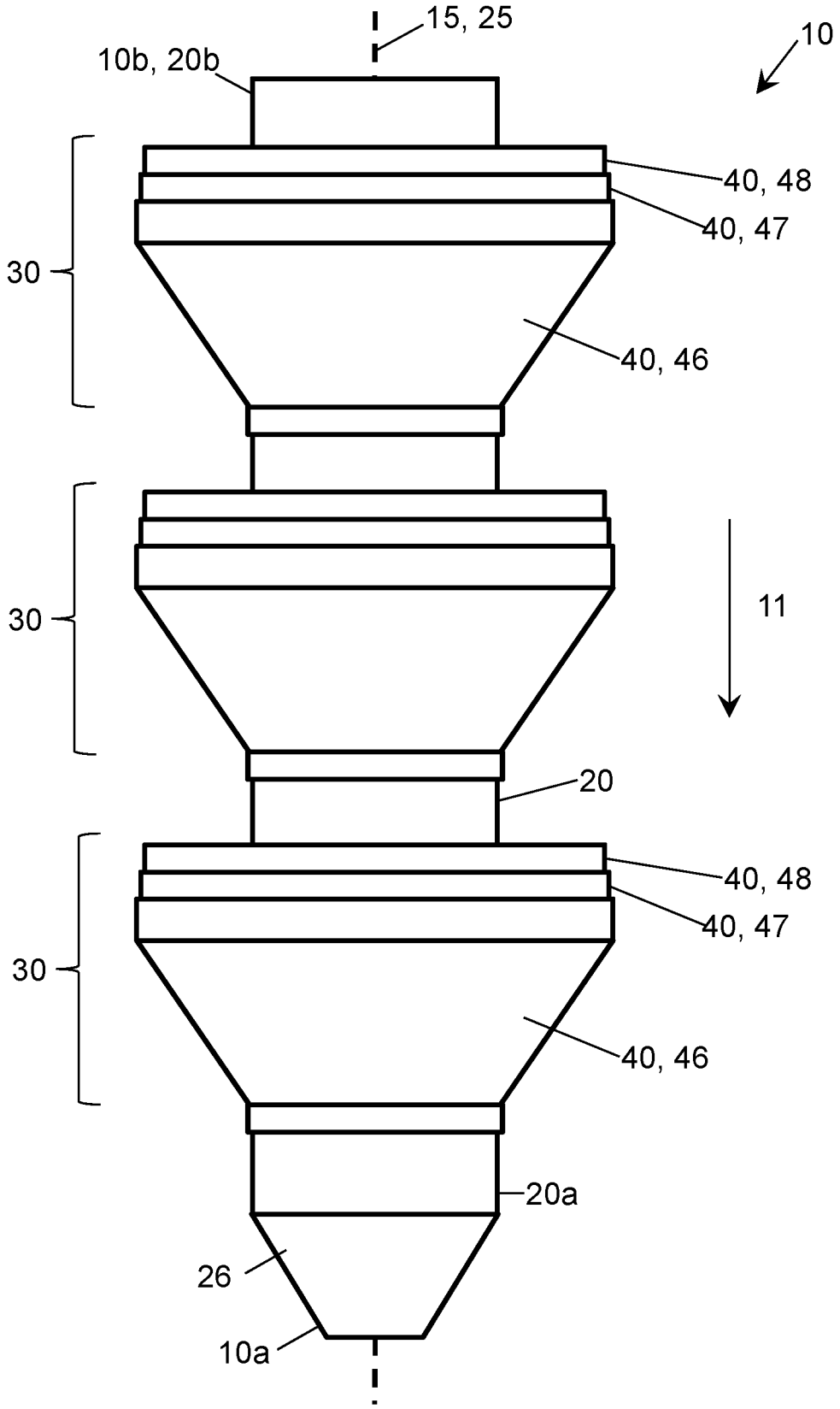
FIG. 1 is a schematic side view of an embodiment of cement wiper plug in accordance with principles described herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct engagement between the two devices, or through an indirect connection that is established via other devices, components, nodes, and connections. In addition, as used herein, the terms "axial" and "axially" generally mean along or parallel to a particular axis (e.g., central axis of a body or a port), while the terms "radial" and "radially" generally mean perpendicular to a particular axis. For instance, an axial distance refers to a distance measured along or parallel to the axis, and a radial distance means a distance measured perpendicular to the axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. As used herein, the terms "approximately," "about," "substantially," and the like mean within 10% (i.e., plus or minus 10%) of the recited value. Thus, for example, a recited angle of "about 80 degrees" refers to an angle ranging from 72 degrees to 88 degrees.

As previously described, cement wiper plugs are used to separate and isolate the cement slurry from other fluids in the borehole during a cementing operation. Cement wiper plugs often include a central mandrel and a plurality of annular wiper fins mounted to and spaced along the length of the mandrel. The wiper fins are typically made of resilient rubber, and are designed to slidingly engage and seal against the inner surface of the casing. The fins typically extend to an outer radius that is greater than the inner radius of the casing when in their relaxed state, and flex when inserted into the casing such that the fins are biased into sealing engagement with the inner surface of the casing. As the wiper plug advances through the casing, the outer ends of the fins experience abrasive and frictional wear. If sufficient wear occurs, some fluids may undesirably bypass the wiper plug and comingle with other fluids in the casing. One approach to account for wear of fins, is to simply increase the total number of fins. However, this often results in an increase in the overall length of the wiper plug. In addition, as wiper plugs are usually designed such that all the fins contact the inner surface of the casing simultaneously, all the fins are simultaneously susceptible to abrasive and frictional wear. Accordingly, embodiments described herein are directed to cement wiper plugs with resilient, annular fins designed and positioned to enhance durability of the wiper plugs by selectively limiting engagement of one or more fins with the inner surface of the casing.

Figure 2:
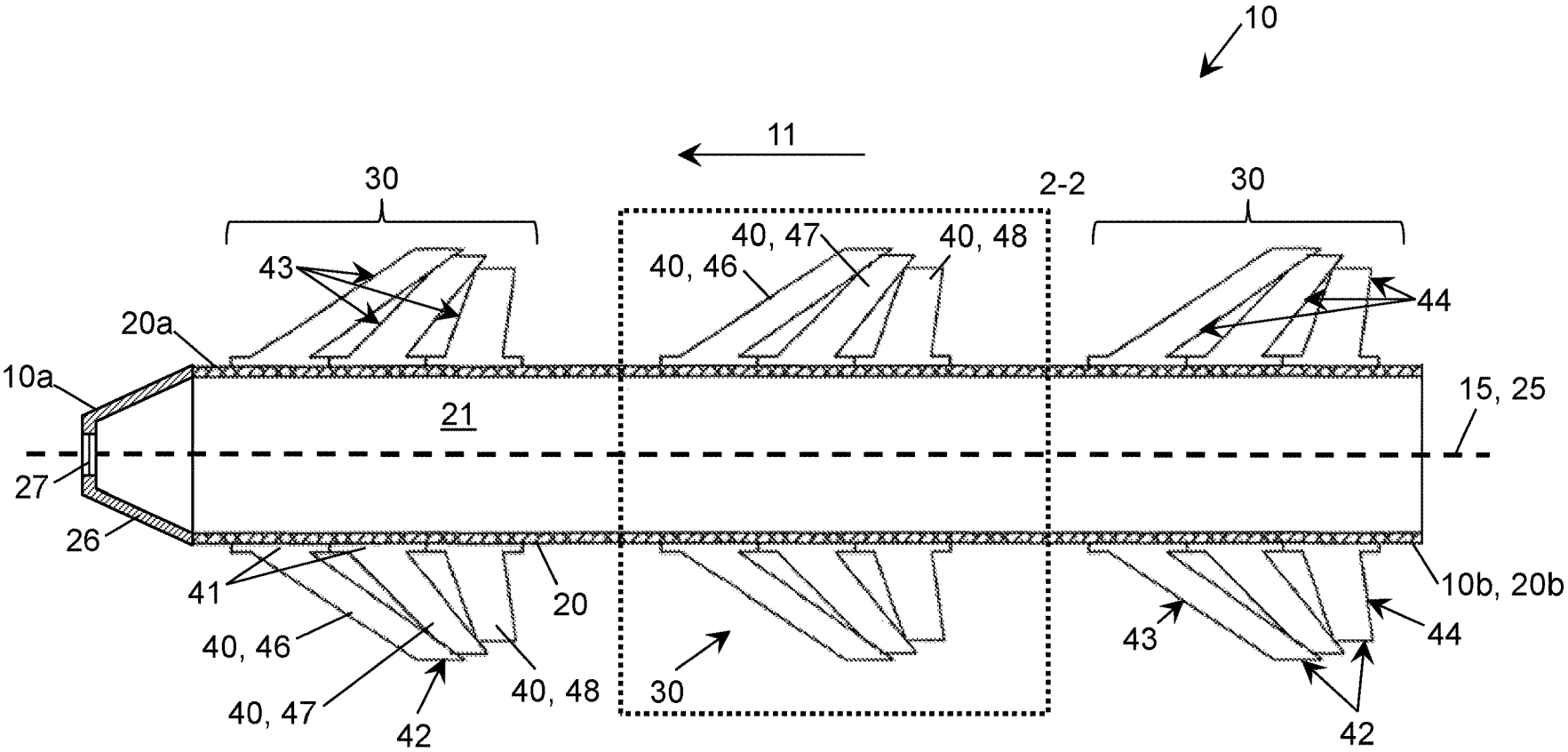
FIG. 2 is a schematic cross-sectional side view of the cement wiper plug of FIG. 1 with each fin shown in its unflexed position.
Figure 6:
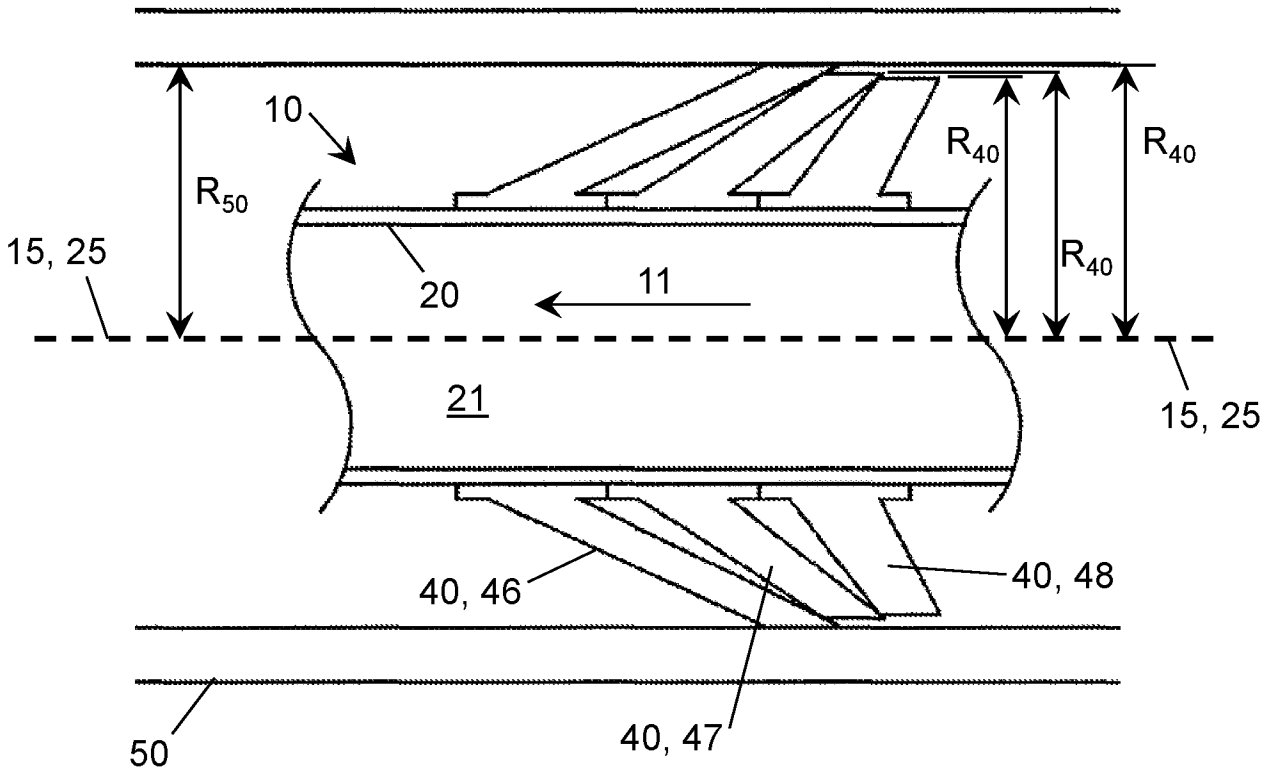
FIG. 6 is an enlarged partial cross-sectional side view of the cement wiper plug of FIG. 1 taken in section 3-3 of FIG. 2 with the cement wiper plug disposed within and coaxially aligned with the casing for which it was designed with each fin in the flexed position to illustrate the radius of the fins in the flexed positions relative to the inner radius of the casing.

Referring now to FIGS. 1 and 2, an embodiment of a cement wiper plug 10 in accordance with the principles described herein is shown. Wiper plug 10 has a central or longitudinal axis 15, a first or leading end 10*a*, and a second or trailing end 10*b* opposite end 10*a*. As will be described in more detail below, wiper plug 10 is designed to be launched or deployed down casing (e.g., casing 50 as shown in FIG. 6) with end 10*a* leading end 10*b* relative to a downhole direction of movement 11 of plug 10 through the casing (i.e., end 10*a* is in front of end 10*b* as plug 10 advances through the casing).

In this embodiment, wiper plug 10 includes an elongate body or mandrel 20 and a plurality of axially spaced sets 30 of resilient annular wiper fins 40 mounted to body 20. Sets 30 of annular wiper fins 40 are fixably attached to body 20 and generally extend radially outward therefrom. In this embodiment, three sets 30 of wiper fins 40 are provided, however, in other embodiments, one set, two sets, four sets, or more than four sets of fins (e.g., sets 30 of wiper fins 40) can be provided.

Referring still to FIGS. 1 and 2, body 20 is rigid tubular having a central or longitudinal axis 25 coaxially aligned with axis 15 of plug 10, a first end 20*a* proximal leading end 10*a* of plug 10, a second end 20*b* defining trailing end 10*b* of plug 10, and a central passage or throughbore 21 extending axially from first end 20*a* to second end 20*b*. In this embodiment, an end cap 26 is coupled to end 20*a* and closes off throughbore 21 at end 20*a*. End cap 26 defines leading end 10*a* of plug 10 and includes a rupture or burst disc 27 that can be controllably ruptured by application of a sufficient fluid pressure differential across disc 27 (e.g., a sufficient fluid pressure differential between fluid within throughbore 21 on one side of disc 27 and fluid pressure in the casing on the opposite side of disc 27). With rupture disc 27 intact (i.e., before bursting), fluid cannot bypass wiper plug 10 via through throughbore 21 as fluid is prevented from flowing axially through throughbore 21; however, once rupture disc 27 bursts, fluid can bypass wiper plug 10 via throughbore 21 as fluid is allowed to flow axially through throughbore 21. In general, body 20 and end cap 26 can be made of any rigid material suitable for use in a downhole environment such as aluminum or steel, and burst disc 27 can be any suitable type of burst disc known in the art for use in the downhole environment. Although wiper plug 10 includes burst disc 27 in this embodiment, in other embodiments, no burst disc is included in the wiper plug and the leading end (e.g., end 10*a*) and/or the closed end (e.g., end 10*b*) is solid so as to block and prevent the flow of fluids through the wiper plug.

As shown in FIGS. 1 and 2, the plurality of sets 30 of fins 40 are axially spaced along body 20. The fins 40 within each set 30 are axially adjacent or proximal each other, whereas the different sets 30 are axially spaced apart. As will be described in more detail below, fins 40 in each set 30 flex upon positioning wiper plug 10 in casing 50. In particular, the axially adjacent fins 50 within each set 30 flex and contact each other when wiper plug 10 is disposed in casing 50, whereas fins 40 in different sets 30 also flex but do not contact each other when wiper plug 10 is disposed in casing 50. Accordingly, a set 30 of fins 40 may be described or defined by the axially adjacent fins 40 that contact each other when wiper plug 10 is disposed in the casing 50.

Each fin 40 is annular, and thus, extends circumferentially completely around body 20. Stated differently, each fin 40 may be described as having a central through bore or hole through which body 20 extends. In the embodiment shown in FIGS. 1 and 2, the plurality of sets 30 are uniformly or evenly axially spaced apart, however, in other embodiments, the sets of fins (e.g., the sets 30 of fins 40) may be non-uniformly axially spaced apart. In addition, in this embodiment, each set 30 of fins 40 is the same, and thus, only one set 30 of fins 40 will be described in being understood that each set 30 is the same.

Figure 3:
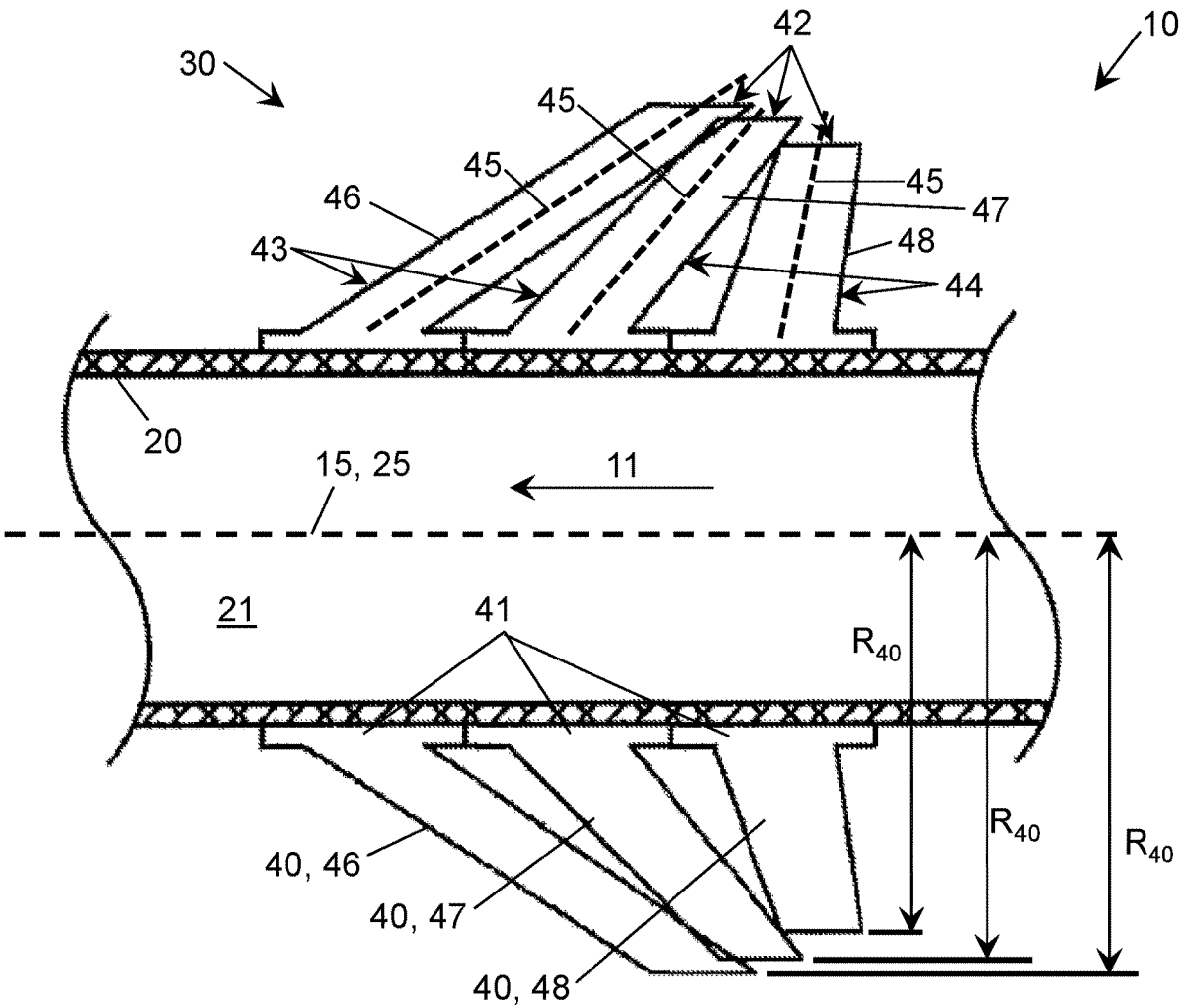
FIG. 3 is an enlarged partial cross-sectional side view of the cement wiper plug of FIG. 1 taken in section 3-3 of FIG. 2.

Referring now to FIG. 3, one set 30 of axially adjacent wiper fins 40 is shown. In this embodiment, set 30 includes three axially adjacent wiper fins 40. Each fin 40 has a radially inner annular base 41 radially adjacent body 20, a radially outer annular surface 42 radially distal body 20, a first surface 43 extending from base 41 to outer surface 42, and a second surface 44 extending from base 41 to outer surface 42. In addition, in cross-sectional side view, each fin 40 may be described as having a central axis 45 that extends generally radially between base 41 and outer surface 42, and is axially centered between the corresponding surfaces 43, 44. Each base 41 is fixably attached to body 20. As will be described in more detail below, outer surfaces 42 of fins 40 in set 30 are designed to sequentially, slidingly and sealingly engage the casing. For a given fin 40, the first surface 43 is positioned in front of and leads the second surface 44 relative to the direction of movement 11, and thus, surfaces 43 may also be referred to as "forward" or "leading" surfaces, whereas surfaces 44 may also be referred to as "rearward" or "trailing" surfaces. Each fin 40 has an outer radius $R_{40}$ measured radially from central axes 15, 25 to the corresponding outer surface 42.

Fins 40 are made of a durable, resilient material(s) designed to flex and be biased into dynamic sealing engagement with the casing. Examples of suitable materials for fins 40 include rubbers and polymeric materials. As will be described in more detail below, when wiper plug 10 is disposed in the casing, fins 40 flex or bend radially inward as outer surfaces 42 are urged radially inward. Accordingly, fins 40 may be described as having an "unflexed" position outside of the casing with fins 40 unbent and unflexed, and a "flexed" position within the casing with fins 40 bent and flexed. For example, in FIGS. 3 and 5, each fin 40 is shown in the unflexed position, whereas in FIG. 6, each fin 40 is shown in the flexed position. As shown in FIG. 4, in the unflexed position, the radius $R_{40}$ of each fin 40 is greater than the inner radius $R_{50}$ of the casing 50 within which wiper plug 10 is advanced during a cementing operation, whereas as shown in FIG. 6, in the flexed positions, the radius $R_{40}$ of each fin 40 is less than or equal to the inner radius $R_{50}$ of the casing 50. In addition, as shown in FIG. 3, in the unflexed positions, central axes 45 of fins 40 are linear and surfaces 43, 44 are frustoconical between base 41 and outer surface 42. However, in the flexed positions, central axis 45 of one or more fins 40 may be curved (i.e., be non-linear), one or more leading surfaces 43 may be convex or bowed outwardly, and one or more trailing surfaces 44 may concave or bowed inwardly.

For purposes of clarity and further explanation, the three fins 40 of set 30 are also labeled with reference numerals 46, 47, 48, where fin 46 leads fins 47, 48 relative to the direction of movement 11 of wiper plug 10, fin 47 is positioned axially between fins 46, 48, and fin 48 trails fins 46, 47 relative to the direction of movement 11 of wiper plug 10. As shown in FIG. 3, in this embodiment, with each fin 46, 47, 48 is in its unflexed position, the radius $R_{40}$ of leading fin 46 is greater than the radius $R_{40}$ of intermediate fin 47, and the radius $R_{40}$ of intermediate fin 47 is greater than the radius $R_{40}$ of trailing fin 48. Thus, in this embodiment, each fin 46, 47, 48 in set 30 has a different radius $R_{40}$, and more specifically, the outer radii $R_{40}$ of fins 46, 47, 48 in set 30 successively decrease moving axially from the leading most fin 46 of set 30 to the trailing most fin 48 of set 30. In some embodiments described herein, moving from leading most fin (e.g., fin 46) to trailing most fin (e.g., fin 48) of a set of fins (e.g., set 30), the outer radius (e.g., outer radius $R_{40}$) of each successive fin in the set (e.g., each fin 46, 47, 48 in set 30) ranges from 80% to 95% of the outer radius of the immediately adjacent, leading fin. Thus, for example, in the embodiment shown in FIG. 3, the radius $R_{40}$ of fin 47 is 80-95% of the radius $R_{40}$ of fin 46, and radius $R_{40}$ of fin 48 is 80-95% of the radius $R_{40}$ of fin 47. In other embodiments, the radii of two or more fins within a set may be the same (e.g., radii $R_{40}$ of two or more fins 46, 47, 48 in set 30 may be the same).

Figure 4C:
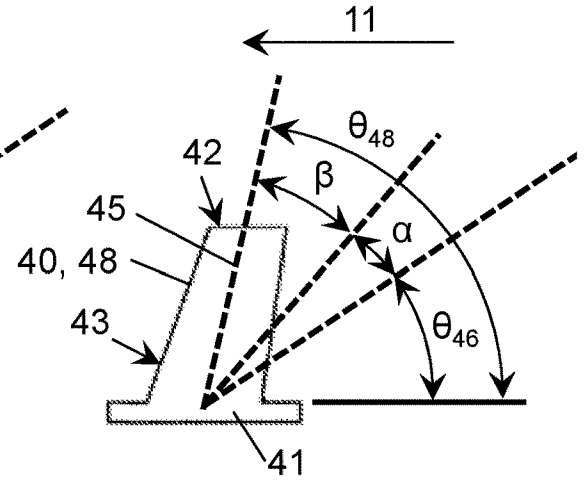
FIGS. 4*a*-4*c* are enlarged cross-sectional partial views of each fin of one set of fins of FIG. 1 with each fin shown in its unflexed position.
Figure 4B:
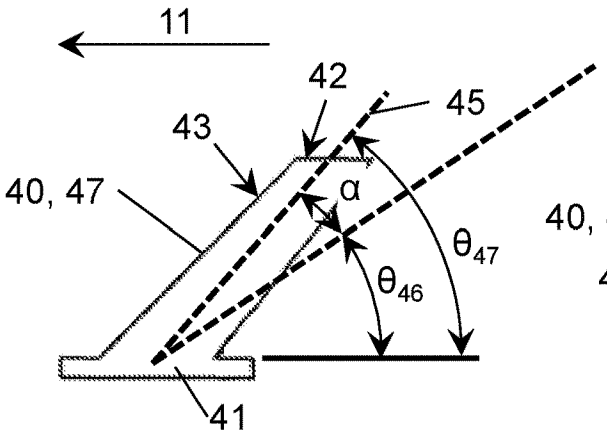
Figure 4A:
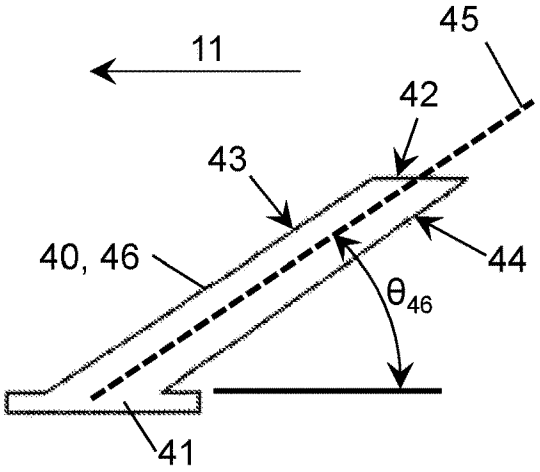
Figure 5:
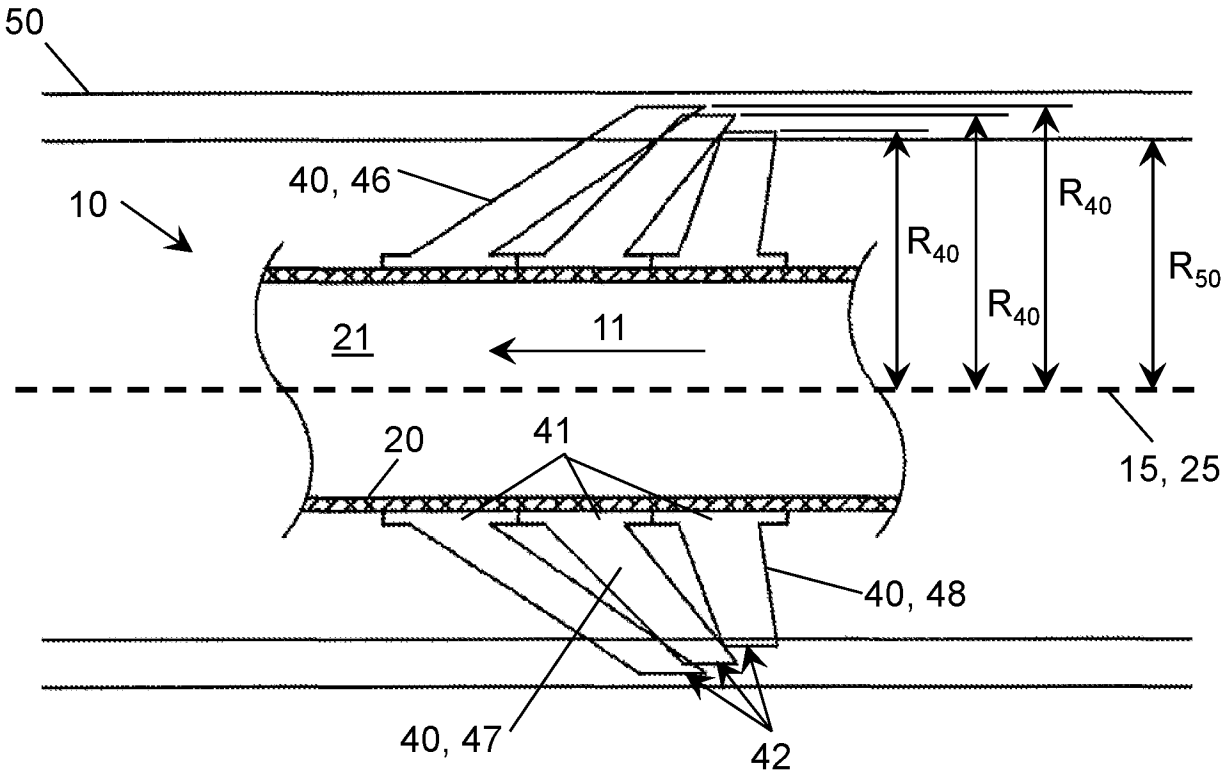
FIG. 5 is an enlarged partial cross-sectional side view of the cement wiper plug of FIG. 1 taken in section 3-3 of FIG. 2 with the cement wiper plug disposed within and coaxially aligned with the casing for which it was designed and with each fin in the unflexed position to illustrate the radius of the fins in the unflexed positions relative to the inner radius of the casing.

As best shown in FIGS. 4*a*-4*c*, the central axis 45 of each fin 46, 47, 48 is disposed at an acute angle $\theta_{46}$, $\theta_{47}$, $\theta_{48}$, respectively, measured from central axes 15, 25 to the corresponding central axis 45 in cross-sectional side view. Angle $\theta_{47}$ is equal to angle $\theta_{46}$ plus an angle $\alpha$, and angle $\theta_{48}$ is equal to angle $\theta_{46}$ plus angle $\alpha$ and an angle $\beta$, where each angle $\alpha$, $\beta$ is greater than or equal to zero. Thus, angle $\theta_{46}$ is less than or equal to angle $\theta_{47}$, and angle $\theta_{47}$ is less than or equal to angle $\theta_{48}$. In this embodiment, each angle $\alpha$, $\beta$ is an acute angle greater than zero, and thus, with each fin 46, 47, 48 is in its unflexed position, acute angle $\theta_{46}$ of leading fin 46 is greater than acute angle $\theta_{47}$ of intermediate fin 47, and acute angle $\theta_{47}$ of intermediate fin 47 is greater than acute angle $\theta_{48}$ of trailing fin 48. Thus, in this embodiment, the angles $\theta_{46}$, $\theta_{47}$, $\theta_{48}$ of fins 46, 47, 48 in set 30 successively increase moving axially from the leading most fin 46 of set 30 to the trailing most fin 48. Although each angle $\theta_{46}$, $\theta_{47}$, $\theta_{48}$ is different in this embodiment, in other embodiments, two or more of the acute angles of the fins in a set (e.g., two or more of the acute angles $\theta_{46}$, $\theta_{47}$, $\theta_{48}$ of fins 46, 47, 48 in set 30) may be the same. For example, in one embodiment, the angles of the leading fin and intermediate fin in a set (e.g., acute angles $\theta_{46}$, $\theta_{47}$ of fins 46, 47) are the same, while the angle of the trailing fin (e.g., acute angle $\theta_{48}$ of fin 48) is greater than the angles of the leading fin and intermediate fin.

It should also be appreciated that due to the axial positioning, radii $R_{40}$, and angles $\theta_{46}$, $\theta_{47}$, $\theta_{48}$ of fins 46, 47, 48 in this embodiment, the radially outer portion of each fin 46, 47, 48 contacts the axially adjacent fin(s) 46, 47, 48 with fins 46, 47, 48 in the unflexed positions. In particular, the radially outer portion of leading fin 46 contacts a radially outer portion of intermediate fin 47, and the radially outer portion of intermediate fin 47 contacts the radially outer portion of trailing fin 48. In other embodiments, two or more fins within a set (e.g., fins 46, 47, 48 of set 30) may not contact with the fins in the unflexed positions. For example, in one embodiment, the leading fin and intermediate fin of a set (e.g., fins 46, 47 of set 30) are the same (e.g., angles $\theta_{46}$, $\theta_{47}$ of fins 46, 47 are the same and radii $R_{40}$ of fins 46, 47 are the same), and thus, the leading fin and the intermediate fin do not contact in the unflexed positions.

Referring now to FIG. 6, cement wiper plug 10 is shown after it is initially disposed within casing 50 (before being advanced through casing 50 in direction 11). As previously described, in the unflexed positions, the radius $R_{40}$ of each fin 46, 47, 48 is greater than the inner radius $R_{50}$ of casing 50. Thus, when wiper plug 10 is disposed in casing 50, each fin 46, 47, 48 flexes radially inward so as to fit within casing 50. Such flexing may be due to direct contact with casing 50 or direct contact with an axially adjacent fin. More specifically, in embodiments described herein, fins 46, 47, 48 are axially positioned relative to each other, sized (e.g., radii $R_{40}$), and angled (e.g., angles $\theta_{46}$, $\theta_{47}$, $\theta_{48}$) such that leading fin 46 flexes radially inward due to direct contact with the inner surface of casing 50, whereas each fin 47, 48 flexes radially inward due to direct contact with the radially outer portion of the axially adjacent, leading fin 46, 47, respectively. In other words, leading fin 46 flexes radially inward in response to direct contact with casing 50, intermediate fin 47 flexes radially inward in response to the flexing of leading fin 46 and direct contact with leading fin 46, and trailing fin 48 flexes radially inward in response to the flexing of intermediate fin 47 and direct contact with intermediate fin 48. Consequently, although the outer radius $R_{40}$ of each fin 46, 47, 48 is greater than inner radius $R_{50}$ of casing when fins 46, 47, 48 are in their unflexed positions, when wiper plug 10 is placed in casing 50, radially outer surface 42 of leading fin 47 contacts casing 50 (i.e., radius $R_{40}$ of leading fin 46 is equal to inner radius $R_{50}$), however, radially outer surfaces 42 of remaining fins 47, 48 in set 30 do not contact casing 50 (i.e., radius $R_{40}$ of each fin 47, 48 is less than inner radius $R_{50}$). More specifically, as shown in FIG. 6, radius $R_{40}$ of leading fin 46 is equal to radius $R_{50}$ of casing 50, while the radius $R_{40}$ of the remaining fins 47, 48 successively decrease—radius $R_{40}$ of intermediate fin 47 is less than radius $R_{40}$ of leading fin 46 and radius $R_{50}$ of casing 50, and radius $R_{40}$ of trailing fin 47 is less than radius $R_{40}$ of intermediate fin 47 and radius $R_{50}$.

In the embodiment of cement wiper plug 10 described above, each set 30 of fins 40 is the same. However, in other embodiments, two or more sets of fins (e.g., two or more sets 30 of fins 40) may be different. For example, in some embodiments, the fins in different sets may be oriented at different angles, extend to different radii, or combinations thereof.

Figure 7A:
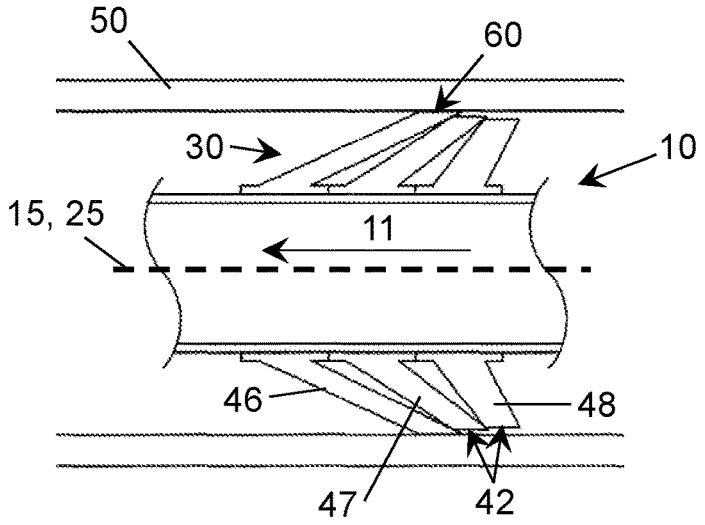
FIGS. 7*a*-7*c* are sequential partial cross-sectional side views of the cement wiper plug of FIG. 1 advancing through the casing and illustrating the successive sealing engagement and wear of each fin.
Figure 7B:
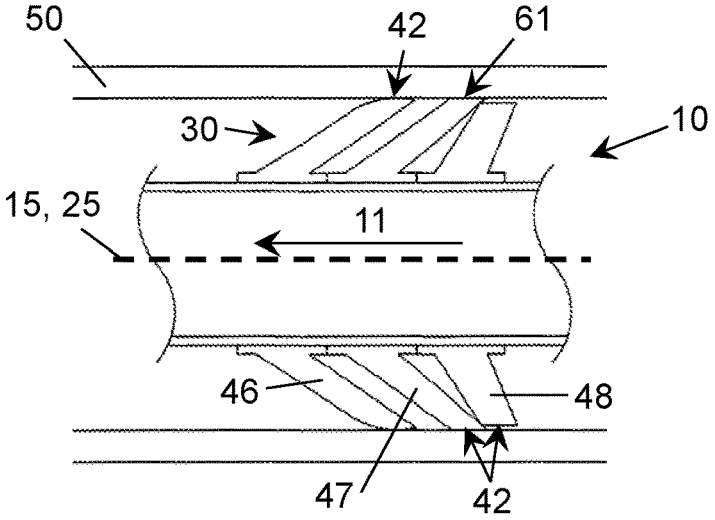
Figure 7C:
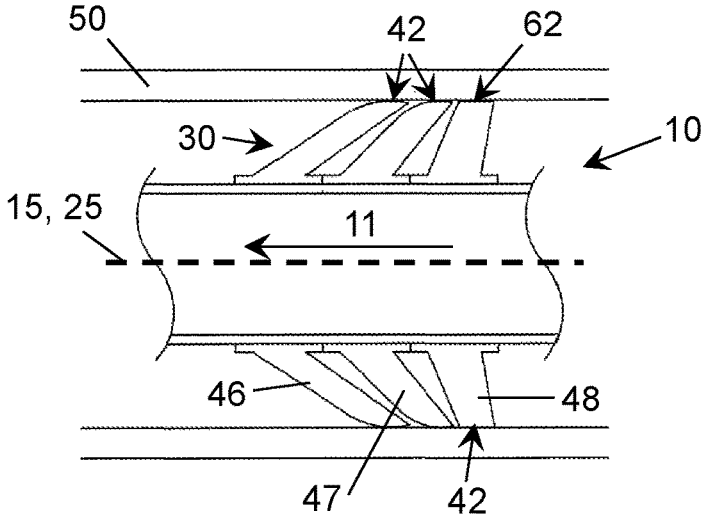

Referring now to FIGS. 7*a*-7*c*, sequential cross-sectional side views of wiper plug 10 advancing through casing 50 during a cementing operation are shown. As wiper plug 10 advances through casing in direction 11, fins 46, 47, 48 successively wear. In particular, fins 46, 47, 48 successively wear moving axially rearward relative to direction 11 from the leading most fin to the trailing most fin—leading fin 46 wears first, then the next axially adjacent, trailing fin 47 wears, and then the next axially adjacent, trailing fin 48 wears, and so on. In FIG. 7*a*, wiper plug 10 is shown advancing through casing 50 in direction 11 prior to any noticeable wear to any fins 46, 47, 48; in FIG. 7*b*, wiper plug 10 is shown advancing through casing 50 in direction 11 after significant wear to leading fin 46 but with little to no wear of remaining fins 47, 48; and in FIG. 7*c*, wiper plug 10 is shown advancing through casing 50 in direction 11 after significant wear to fins 46, 47 but with little to no wear of remaining fin 48. Although only one set 40 of fins 46, 47, 48 is shown in FIGS. 7*a*-7*c*, it should be appreciated that each set 30 of fins 40 of wiper plug 10 functions and behaves in a similar manner.

Referring first to FIG. 7*a*, as previously described with respect to FIG. 6, when wiper plug 10 is initially launched in casing 50, fins 46, 47, 48 in set 30 flex and contact each other. It should be appreciated that leading fin 46 directly contacts casing 50, however, fins 47, 48 are radially spaced apart from casing 50 and do not directly contact casing 50. Leading fin 46 is biased into sealing engagement with casing 50 by its own resiliency as well as the resiliency of the remaining flexed fins 47, 48. More specifically, due to the axial position and angular orientation of fins 46, 47, 48, flexed fin 48 biases adjacent fin 47 radially outward and axially forward in direction 11, and flexed fin 47 biases adjacent fin 46 radially outward and axially forward in direction 11, thereby urging fin 46 into direct and sealing engagement with casing 50. Consequently, an annular dynamic seal 60 is formed between radially outer surface 42 of fin 46 and casing 50. As wiper plug 10 moves through casing 50 in direction 11, annular seal 60 minimizes and/or prevents fluids within the casing 50 from bypassing wiper plug 10, thereby maintaining separation of the fluids on opposite axial sides of wiper plug 10. Sliding engagement of fin 46 and casing 50 abrasively wears fin 46. However, annular seal 60 is maintained for a period of time as fin 46 is biased radially outward and axially forward into engagement with casing 50 by its own resiliency and the resiliency of fins 47, 48 as previously described. As shown in FIG. 7*a*, since fins 47, 48 are not in contact with casing 50, fins 47, 48 are generally protected and do not abrasively wear.

Moving now to FIGS. 7*a* and 7*b*, when the radially outer surface 42 of fin 46 is sufficiently worn, it no longer contacts adjacent fin 47, and thus, fins 47, 48 no longer bias fin 46 radially outward and axially forward in direction 11. In particular, fin 46 is biased radially outward and axially forward in direction 11 by its own resiliency to the unflexed position, and thus, as outer surface 42 of fin 46 wears and engagement between outer surface 42 of fin 46 and casing 50 decreases, fin 46 slowly transitions toward its unflexed position. At a sufficient degree of wear of outer surface 42, fin 46 transitions to or proximate to the unflexed position.

As shown in FIG. 7*b*, as fin 46 wears and transitions out of contact with axially adjacent fin 47, flexed fin 47 transitions into contact with casing 50 as it is biased radially outward and axially forward in direction 11 by its own resiliency as well as the resiliency of remaining flexed fin 48, which continues to contact fin 47. Consequently, an annular dynamic seal 61 is formed between radially outer surface 42 of fin 47 and casing 50. As wiper plug 10 moves through casing 50 in direction 11, annular seal 61 minimizes and/or prevents fluids within the casing 50 from bypassing wiper plug 10, thereby maintaining separation of the fluids on opposite axial sides of wiper plug 10. The resiliency of flexed fin 46 may be sufficient to maintain annular seal 60 for a period of time after annular seal 61 is formed, but continued abrasive wear of fin 46 as wiper plug 10 continues to move through casing 50 eventually results in failure of seal 60. The sliding engagement of fin 47 and casing 50 as wiper plug 10 moves through casing 50 in direction 11 also abrasively wears fin 47. However, annular seal 61 is maintained for a period of time as fin 47 is biased radially outward and axially forward into engagement with casing 50 by its own resiliency and the resiliency of fin 48. As shown in FIG. 7*b*, fin 48 is not in contact with casing 50, and thus, fin 48 is generally protected and does not abrasively wear.

Moving now to FIGS. 7*b* and 7*c*, when the radially outer surface 42 of fin 47 is sufficiently worn, it no longer contacts adjacent fin 48, and thus, fin 48 no longer bias fin 47 radially outward and axially forward in direction 11. Similar to fin 46 previously described, fin 47 is biased radially outward and axially forward in direction 11 by its own resiliency to the unflexed position, and thus, as outer surface 42 of fin 47 wears and engagement between outer surface 42 of fin 47 and casing 50 decreases, fin 47 slowly transitions toward its unflexed position. At a sufficient degree of wear of outer surface 42, fin 47 transitions to or proximate to the unflexed position.

As shown in FIG. 7*c*, as fin 47 wears and transitions out of contact with axially adjacent fin 48, flexed fin 48 transitions into contact with casing 50 as it is biased radially outward and axially forward in direction by its own resiliency. Consequently, an annular dynamic seal 62 is formed between radially outer surface 42 of fin 48 and casing 50. As wiper plug 10 moves through casing 50 in direction 11, annular seal 62 minimizes and/or prevents fluids within the casing 50 from bypassing wiper plug 10, thereby maintaining separation of the fluids on opposite axial sides of wiper plug 10. The resiliency of flexed fin 47 is sufficient to maintain annular seal 61 for a period of time after annular seal 62 is formed, but continued abrasive wear of fin 47 as wiper plug 10 continues to move through casing 50 eventually results in failure of seal 61. The sliding engagement of fin 48 and casing 50 as wiper plug 10 moves through casing 50 in direction 11 also abrasively wears fin 48. However, annular seal 62 is maintained for a period of time as fin 48 is biased radially outward and axially forward into engagement with casing 50 by its own resiliency.

In the manner described, fins 46, 47, 48 sequentially transition into contact and sealing engagement with casing 50. Prior to engaging casing 50, wear of fins 47, 48 is generally minimized and/or prevented. However, even during periods when fins 47, 48 are not contacting casing 50, they continue to bias fins 46, 47, respectively, radially outward and axially forward in direction 11. This combination of features offers the potential to maintain annular seals 60, 61 for a longer period of time and improve the overall durability and operating lifetime of wiper plug 10.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A cement wiper plug for deployment in casing having an inner radius, the wiper plug having a central axis, a leading end, and a trailing end opposite the leading end, the cement wiper plug comprising:

an elongate body; and a first plurality of axially adjacent annular fins mounted to the body, wherein each fin extends radially outward from the body and each fin extends circumferentially about the body;

wherein the first plurality of fins includes a first fin and a second fin axially adjacent the first fin, wherein the second fin is axially positioned between the first fin and the trailing end, wherein the first fin and the second fin are configured to contact each other in the casing, and wherein the second fin is configured to bias the first fin radially outward and axially forward toward the leading end;

wherein each fin of the first plurality of fins extends radially outward from the body to an outer radius measured radially from the central axis, wherein the outer radius of the first fin and the second fin are different.

2. The cement wiper plug of claim 1, wherein the outer radius of each fin of the first plurality of fins is greater than the inner radius of the casing.

3. The cement wiper plug of claim 1, wherein the first plurality of fins comprises a third fin, wherein the second fin is axially positioned between the first fin and the third fin.

4. The cement wiper plug of claim 1, wherein the outer radius of the first fin is greater than the outer radius of the second fin or greater than the outer radius of the third fin.

5. The cement wiper plug of claim 1, wherein each fin of the first plurality of fins has a base fixably coupled to the body, a radially outer surface opposite the base, a leading surface proximal the leading end and extending radially from the base to the radially outer surface, and a trailing surface proximal the trailing end and extending radially from the base to the radially outer surface;

wherein each fin of the first plurality of fins has a central axis in cross-sectional side view that is centered between the leading surface and the trailing surface of the fin;

wherein each fin of the first plurality of fins is oriented at an acute angle measured from the central axis of the body to the central axis of the fin.

6. The cement wiper plug of claim 5, wherein the first plurality of fins comprises a third fin, wherein the second fin is axially positioned between the first fin and the third fin;

wherein the acute angle of the first fin is less than or equal to the acute angle of the second fin, and the acute angle of the second is less than or equal to the acute angle of the third fin.

7. The cement wiper plug of claim 5, wherein the acute angles of the first plurality of fins successively increase moving axially from the first fin of the first plurality of fins to a last fin of the first plurality of fins.

8. The cement wiper plug of claim 1, further comprising:

a second plurality of axially adjacent annular fins mounted to the body, wherein the second plurality of axially adjacent annular fins is axially spaced from the first plurality of axially adjacent annular fins;

wherein each fin of the second plurality of fins extends radially outward from the body and each fin of the second plurality of fins extends circumferentially about the body;

wherein the second plurality of fins includes a first fin and a second fin axially adjacent the first fin of the second plurality of fins, wherein the second fin of the second plurality of fins is axially positioned between the first fin of the second plurality of fins and the trailing end, wherein the first fin of the second plurality of fins and the second fin of the second plurality of fins are configured to contact each other in the casing, and wherein the second fin of the second plurality of fins is configured to bias the first fin of the second plurality of fins radially outward and axially forward toward the leading end;

wherein each fin of the second plurality of fins extends radially outward from the body to an outer radius measured radially from the central axis, wherein the outer radius of is the first fin of the second plurality of fins and the second fin of the second plurality of fins are different.

9. The cement wiper plug of claim 8, wherein the second plurality of fins comprises a third fin, wherein the second fin of the second plurality of fins is axially positioned between the first fin of the second plurality of fins and the third fin of the second plurality of fins ;

wherein the outer radius of the first fin of the second plurality of fins is greater than the outer radius of second fin of the second plurality of fins or greater than the outer radius of the third fin of the second plurality of fins.

10. The cement wiper plug of claim 8, wherein each fin of the second plurality of fins has a base fixably coupled to the body, a radially outer surface opposite the base, a leading surface proximal the leading end and extending radially from the base to the radially outer surface, and a trailing surface proximal the trailing end and extending radially from the base to the radially outer surface;

wherein each fin of the second plurality of fins has a central axis in cross-sectional side view that is centered between the leading surface and the trailing surface of the fin;

wherein each fin of the second plurality of fins is oriented at an acute angle measured from the central axis of the body to the central axis of the fin.

11. The cement wiper plug of claim 10, wherein the acute angle of the first fin of the second plurality of fins is less than or equal to the acute angle of the second fin of the second plurality of fins, and the acute angle of the second fin of the second plurality of fins is less than or equal to the acute angle of the third fin of the second plurality of fins.

12. A cement wiper plug for deployment in casing, the wiper plug having a central axis, a leading end, and a trailing end opposite the leading end, comprising:

an elongate body;

a first plurality of axially adjacent annular fins mounted to the body, wherein each fin of the first plurality of fins extends radially outward from the body and each fin of the first plurality of fins extends circumferentially about the body;

wherein the first plurality of fins comprises a leading fin proximal the leading end of the cement wiper plug, a trailing fin proximal the trailing end of the cement wiper plug, and at least one intermediate fin axially positioned between the leading fin and the trailing fin;

wherein the leading fin and the at least one intermediate fin are configured to contact each other in the casing, and wherein the at least one intermediate fin is configured to bias the leading fin radially outward and axially forward toward the leading end;

wherein each fin of the first plurality of fins has a base fixably coupled to the body, a radially outer surface opposite the base, a leading surface proximal the leading end and extending radially from the base to the radially outer surface, and a trailing surface proximal the trailing end and extending radially from the base to the radially outer surface;

wherein each fin of the first plurality of fins has a central axis in cross-sectional side view that is centered between the leading surface and the trailing surface of the fin;

wherein each fin of the first plurality of fins is oriented at an acute angle measured from the central axis of the body to the central axis of the fin;

wherein each fin of the first plurality of fins extends radially outward from the body to an outer radius measured radially from the central axis;

wherein the outer radius of at least two fins of the first plurality of fins are different or the acute angle of at least two fins of the first plurality of fins are different.

13. The cement wiper plug of claim 12, wherein the acute angle of a first fin of the first plurality of fins is greater than the acute angle of a second fin of the first plurality of fins, wherein the first fin is more proximal the leading end than the second fin.

14. The cement wiper plug of claim 12, wherein each fin of the first plurality of fins contacts each axially adjacent fin in the first plurality of fins.

15. The cement wiper plug of claim 12, wherein the acute angle of each fin of the first plurality of fins is different.

16. The cement wiper plug of claim 12, wherein the acute angle of the leading fin of the first plurality of fins is less than the acute angle of the at least one intermediate fin of the first plurality of fins, and the acute angle of the at least one intermediate fin of the first plurality of fins is less than the acute angle of the trailing fin of the first plurality of fins.

17. The cement wiper plug of claim 12, wherein the outer radius of each fin of the first plurality of fins is different.

18. The cement wiper plug of claim 17, wherein the acute angles of the first plurality of fins successively increase moving axially from the leading fin of the first plurality of fins to a trailing fin of the first plurality of fins.

19. The cement wiper plug of claim 12, wherein the leading surface of each fin of the first plurality of fins is a frustoconical surface and the trailing surface of each fin of the first plurality of fins is a frustoconical surface.

* * * * *